US010233395B2

(12) United States Patent
Ward et al.

(10) Patent No.: US 10,233,395 B2
(45) Date of Patent: Mar. 19, 2019

(54) PROCESS FOR CONVERTING MIXED WASTE PLASTIC (MWP) INTO VALUABLE PETROCHEMICALS

(71) Applicants: SAUDI BASIC INDUSTRIES CORPORATION, Riyadh (SA); SABIC GLOBAL TECHNOLOGIES B.V., PX Bergen Op Zoom (NL); Andrew Mark Ward, Wilton Centre Wiltshire (GB); Arno Johannes Maria Oprins, Geleen (NL); Ravichander Narayanaswamy, Bangalore (IN)

(72) Inventors: Andrew Mark Ward, Wilton Centre Wiltshire (GB); Arno Johannes Maria Oprins, Geleen (NL); Ravichander Narayanaswamy, Bangalore (IN)

(73) Assignees: SAUDI BASIC INDUSTRIES CORPORATION, Riyadh (SA); SABIC GLOBAL TECHNOLOGIES B.V., Bergen Op Zoom (NL)

( * ) Notice: Subject to any disclaimer, the term of this patent is extended or adjusted under 35 U.S.C. 154(b) by 28 days.

(21) Appl. No.: 15/121,104

(22) PCT Filed: Dec. 23, 2014

(86) PCT No.: PCT/EP2014/079151
§ 371 (c)(1),
(2) Date: Aug. 24, 2016

(87) PCT Pub. No.: WO2015/128033
PCT Pub. Date: Sep. 3, 2015

(65) Prior Publication Data

US 2016/0362609 A1 Dec. 15, 2016

(30) Foreign Application Priority Data

Feb. 25, 2014 (EP) ..... 14156623

(51) Int. Cl.
*C10G 1/10* (2006.01)
*C10G 47/00* (2006.01)
(Continued)

(52) U.S. Cl.
CPC ..... *C10G 1/10* (2013.01); *C10G 9/36* (2013.01); *C10G 45/00* (2013.01); *C10G 45/02* (2013.01);
(Continued)

(58) Field of Classification Search
None
See application file for complete search history.

(56) References Cited

U.S. PATENT DOCUMENTS 3,172,834 A * 3/1965 Kozlowski ..... C10L 1/06 208/111.25
4,137,147 A * 1/1979 Franck ..... B01J 29/20 208/61
(Continued)

FOREIGN PATENT DOCUMENTS

JP 50087466 7/1975
JP 2007119648 5/2007
WO 2013169367 A1 11/2013

OTHER PUBLICATIONS

International Search Report and Written Opinion of International Application No. PCT/EP2014/079151; 10 pages; dated Mar. 18, 2015.
(Continued)

*Primary Examiner* — Philip Y Louie
(74) *Attorney, Agent, or Firm* — Norton Rose Fulbright US LLP

(57) ABSTRACT

A process for converting mixed waste plastic (MWP) into valuable petrochemicals including feeding MWP to a pyrolysis reactor, converting the MWP into a gaseous stream
(Continued)

and a liquid stream, and further processing the gaseous stream into valuable petrochemicals.

10 Claims, 1 Drawing Sheet

(51) Int. Cl.

| | |
|---|---|
| ***C10G 47/36*** | (2006.01) |
| ***C10G 45/00*** | (2006.01) |
| ***C10G 45/02*** | (2006.01) |
| ***C10G 65/12*** | (2006.01) |
| ***C10G 69/06*** | (2006.01) |
| ***C10G 9/36*** | (2006.01) |
| ***C10G 69/02*** | (2006.01) |
| ***C10G 70/00*** | (2006.01) |

(52) U.S. Cl.
CPC ..... *C10G 47/00* (2013.01); *C10G 47/36* (2013.01); *C10G 65/12* (2013.01); *C10G 69/02* (2013.01); *C10G 69/06* (2013.01); *C10G 70/00* (2013.01); *C10G 2300/1003* (2013.01); *C10G 2300/1074* (2013.01); *C10G 2300/202* (2013.01); *C10G 2300/205* (2013.01)

(56) References Cited

U.S. PATENT DOCUMENTS

| | | | | |
|---|---|---|---|---|
| 6,436,168 | B1 * | 8/2002 | Uematsu | C10B 53/00 75/471 |
| 8,404,912 | B1 * | 3/2013 | Miller | C10G 47/00 208/107 |
| 2003/0047437 | A1 * | 3/2003 | Stankevitch | C10G 49/16 201/25 |
| 2009/0151233 | A1 | 6/2009 | Miller | |

OTHER PUBLICATIONS

H.S. Joo et al: "Continuous Upgrading of a Plastics Pyrolysis Liquid to an Environmentally Favorable Gasoline Range Product"; Fuel Processing Technology; Jan. 1, 1998, pp. 25-40; SP055110668; DOI: 10.1016/S0378-3820(98) 00067-8; retrieved from the internet: URL:http:/www.sciencedirect.com/science/article/pii/S037838209800678.

Office Action issued in Japanese Patent Application No. 2016-570164, dated Apr. 3, 2018.

* cited by examiner

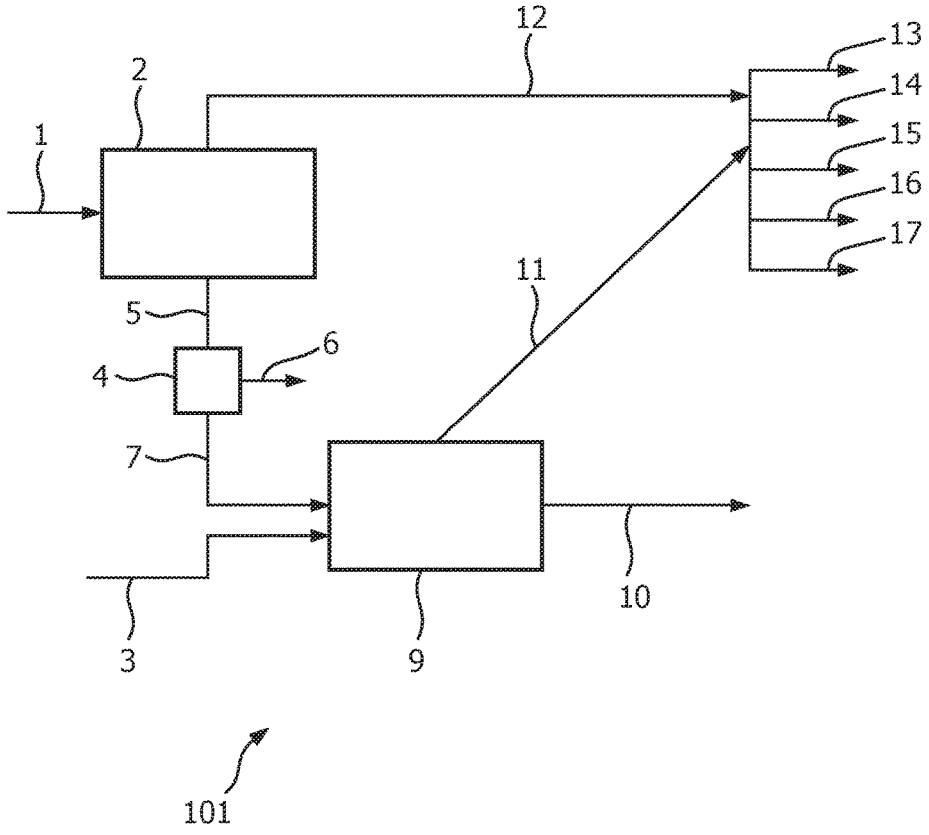
12
13
2
14
1
15
16
17
11
5
6
4
7
10
3
9
101

PROCESS FOR CONVERTING MIXED WASTE PLASTIC (MWP) INTO VALUABLE PETROCHEMICALS

This application is a 35 U.S.C. § 371 of U.S. National Stage Application claiming priority from PCT/EP2014/079151, filed Dec. 23, 2014, which claims priority from EP 14156623.2 filed Feb. 25, 2014.

TECHNICAL FIELD AND BACKGROUND OF THE INVENTION

The present invention relates to a process for converting mixed waste plastic (MWP) into valuable petrochemicals. More in detail, the present process comprises feeding mixed waste plastic (MWP) to a pyrolysis reactor, converting said MWP into a gaseous stream and a liquid stream, and further processing said gaseous stream into valuable petrochemicals.

WO2013/169367 relates to a process for making a high VI lubricating base oil, comprising: a) hydrocracking a blend, comprising (1) a heavy wax derived from pyrolyzing a plastic feed and (2) a lube oil feedstock, in a lube hydrocracking zone in the presence of a hydrocracking catalyst and hydrogen under lube hydrocracking conditions to produce a hydrocracked stream; and b) dewaxing at least a portion of the hydrocracked stream in a hydroisomerization zone in the presence of a hydroisomerization catalyst and hydrogen under hydroisomerization conditions to produce a base oil. Heavy waxes can be prepared by pyrolyzing a plastic feed by means well known to those of skill in the art and are described, for example, in U.S. Pat. No. 6,143,940. The pyrolysis zone effluent typically contains a broad boiling point range of materials. The pyrolysis zone effluent (liquid portion) is very waxy and has a high pour point. It comprises n-paraffins and some olefins.

WO2013/169367 thus discloses a process for producing high VI lube base oils by a process of hydrocracking followed by hydroisomerization and hydrofinishing and employs as feed a mixture of heavy wax from pyrolysis of plastics and a conventional lube oil feedstock. The heavy wax contains 30-90 wt % n-paraffins, 5-25 wt % olefins and <5 wt % aromatics. WO2013/169367 teaches that by co-feeding heavy wax in a hydrocracker feed, the heavy wax concentrated in the 343+ deg C. cut of the product. The objective of this reference is to maximize the 343+ deg C. cut of the products, i.e. to maximize lube base oils (343+ deg C.).

US patent application No 2009/151233 relates to a method comprising the steps of: a) pyrolyzing biomass concurrently with a waste plastic, wherein said waste plastic comprises at least about 75 wt. % polyolefins at a temperature of from about 450° C. to about 650° C. so as to yield pyrolysis oil; b) separating the pyrolysis oil into at least two component fractions comprising a 650° F.–fraction and a 650° F.+fraction; c) hydrotreating at least one of the at least two component fractions so as to yield at least one hydrotreated intermediate; and d) catalytically-isomerizing the at least one hydrotreated intermediate so as to yield at least one isomerized product. An object of US patent application No 2009/151233 is to maximize transportation fuels generated following the steps of co-feeding biomass and plastics to a pyrolysis unit, hydrotreating and isomerizing at least one boiling cut fraction in the product from pyrolysis unit to form a transportation fuel. US patent application No 2009/151233 is not concerned about co-feeding pyrolysis liquid along with petroleum feed to a hydrocracker and the stability of asphaltenes in the combined hydrocracker feed.

An article "Continuous upgrading of a plastics pyrolysis liquid to an environmentally favorable gasoline range product", H. S Joo et al, Fuel Processing Technology, 1 Jan. 1998 (1998-01-01), pages 25-40 relates about upgrading a residual liquid from plastics pyrolysis to a gasoline range product using a three-step sequential process consisting of hydrotreating, hydrocracking and distillation, wherein the original as-received pyrolysis liquid was separated into two fractions by distillation at 90° C. and 20 millibar, and the feed material was the residual fraction amounting to 58% of the raw plastics pyrolysis liquid. This residual fraction was an opaque black liquid containing 71 wt. % gas oil fraction (+205° C.) and 29 wt. % naphtha fraction according to the boiling point distribution. This reference is concerned with hydrocracking of a residual liquid from a plastic pyrolysis process. The liquid products from the pyrolysis process is distilled to produce a distillate fraction (48 wt %) and a residual liquid fraction (52 wt %). This residual liquid fraction containing 29 wt % naphtha range hydrocarbons and 71 wt % hydrocarbons boiling above 205 deg C. is the feed to the hydrocracking process. The product contained 46 wt % of material in the gasoline boiling range. This reference does not thus teach an integrated process for maximizing petrochemicals.

JP11061147A and JP11061148A disclose a method of the pyrolysis of plastics wherein pyrolysis oil is hydrogenated to free it from chlorine and mixed with petroleum oil and fed to a refining unit.

JP10310778A discloses a process wherein pyrolysis oil at 0-100 vol % is mixed with a petroleum stream boiling below 250° C. and fed to a FCC unit. The pyrolysis oil quality should have 0.1-5 g dienes/100 g, 0.0007-1 wt % chlorine and 0.0001-1 wt % oxygen.

Waste plastics are mostly diverted to landfills or are incinerated, with a smaller fraction being diverted to recycling. Over the years, with increased regulations and levies on landfills, the percentage of the post-consumer waste being recycled or incinerated for energy recovery is gradually increasing. The 2009 statistics by Plastics Europe indicate that approximately 24.4 million tons of waste plastics were generated in Europe. Of this, 54% was treated either through recycling (22.6%) or energy recovery (31.3%). Plastics diverted to landfills were approximately 46.1%. Thus, waste plastics disposal into landfills is becoming increasingly difficult.

Pyrolysis of waste plastics to products like naphtha, ethylene, propylene and aromatics can be classified under the category of feedstock recycling of waste plastics. With the naphtha prices increasing dramatically, steam crackers operating on naphtha feed are at a disadvantageous position compared to steam crackers operating on cheaper gaseous hydrocarbon feeds. If a portion of the naphtha feed to the steam crackers is replaced by an equivalent amount of products from plastics conversion processes, like pyrolysis, the economic situation for the steam crackers operating on naphtha feed will improve.

In order to make an impact on the economics of very large volumes in continuous steam cracker plant operations, it is necessary that the pyrolysis process is also continuous. No large scale plants exist today that directly convert waste plastics in a single step to petrochemicals. Previous attempts around the world have been focused on generation of liquid fuels from waste plastics. These plants were small in scale or modular in nature. Reactions carried out in such small scale plants are also carried out for longer residence times, making them less suitable for continuous operations on larger scales. Some earlier attempts have also focused at generating feedstocks for steam crackers from waste plastics. These rely on the availability of steam cracker furnaces for being successful, however. Furthermore, conversion of these produced steam cracker feeds in cracker furnaces would typically result in production of high amounts of methane, which is undesirable.

Pyrolysis of mixed plastic waste (MPW) provides yields of gases and liquids. The gaseous product yield is rich in olefinic components. The liquid product is rich in aromatics. Depending on the severity of operations in the pyrolysis reactor, the yields of light olefins from the pyrolysis reactor can be increased and the yield of aromatics can be increased. The liquid pyrolysis product has all classes of compounds in it in varying proportions i.e. paraffins, iso-paraffins, naphthenes, olefins and aromatics.

BRIEF SUMMARY OF THE INVENTION

An aspect or feature of the present invention is to provide a method for converting mixed waste plastic (MWP) into valuable petrochemicals, wherein the yield of valuable petrochemicals can be increased.

Another aspect or feature of the present invention is to provide a method for converting mixed waste plastic (MWP) into valuable petrochemicals, wherein the chemical composition of the liquid stream coming from the pyrolysis reactor is used for specific hydroprocessing units.

The present invention thus relates to a process for converting mixed waste plastic (MWP) into valuable petrochemicals, comprising feeding mixed waste plastic (MWP) in a pyrolysis reactor, converting in said reactor of MWP into a gaseous stream and a liquid stream, and further processing said gaseous stream into valuable petrochemicals, said process further comprising the steps of:

i) feeding said liquid stream, together with a hydrocracker feed, to a hydrocracking unit;

ii) converting said liquid stream, together with said hydrocracker feed, through hydrocracking into at least one gaseous stream and a liquid stream;

iii) further processing said at least one gaseous stream into valuable petrochemicals, wherein in step i) said liquid stream from said pyrolysis reactor is first separated into a liquid stream having a high aromatics content and a liquid stream having a low aromatics content, wherein said liquid stream having a low aromatics content is then sent to said hydrocracking unit.

According to the present method the yield of valuable petrochemicals is significantly increased because the liquid stream coming from the pyrolysis reactor is sent to a hydrocracking reactor and converted into at least one gaseous stream, from which gaseous stream also valuable petrochemicals can be obtained. Thus, the valuable petrochemicals according to the present invention not only originate from the gaseous stream coming directly from the pyrolysis reactor but from a gaseous stream coming from the hydrocracking reactor, as well.

A problem underlying the present invention is the maximization of petrochemicals, e.g. ethane, propane, butane, ethylene, propylene, butenes and aromatics like benzene, toluene, xylene and ethyl benzene, from mixed plastics and provide an integrated process which also maintains a stable feed to hydrocracker. In a preferred embodiment the present method thus focusses on maximizing production of petrochemicals from mixed plastics in an integrated process combining pyrolyzer, hydrocracking, steam cracker, PDH and BDH. For maximizing the production of petrochemicals, the pyrolysis reactor is preferably operated at higher severity of operations maximizing the yields of light gas olefins and aromatics at the exit of the pyrolyzer. The liquid product boiling below 240 deg C. has about 70% aromatic content. This is different from WO2013/169367. In order to minimize the possibility of generating an unstable feed blend to hydrocracker resulting in precipitation of asphaltenes in the hydrocracker feed, it is preferred to apply blending rules as mentioned in the dependent claims. This is especially useful in embodiments where the petroleum feed is rich in asphaltenes content like Arab heavy atmospheric or vacuum residue. The effect of this combined solution has been demonstrated in the Examples from which it is clearly that the cut C5-150 deg C. is maximized and the 343+ deg C. is minimized. Hence, petrochemicals are maximized. The term "at least one gaseous stream" as used herein means that the hydrocracking reaction can result in a plurality of gaseous streams. Therefore, the present invention is not restricted to any amount of gaseous streams resulting from the hydrocracking unit. The term "valuable petrochemicals" as used herein relates to starting materials, such as for example $H_2$, CO, CO2, $CH_4$, ethane, propane, butanes, ethylene, propylene and butenes, but also to benzene, toluene and xylenes (BTX).

An additional, unexpected benefit of the present method is that the combination of the liquid stream coming from the pyrolysis reactor with a hydrocracker feed, preferably crude distillation bottoms from atmospheric distillation (AR) and/or vacuum distillation (VR), results in a combined feedstream for the hydrocracking unit which has a boiling curve similar to whole crude oil.

Furthermore, a problem with crude distillation bottoms from atmospheric distillation (AR) and/or vacuum distillation (VR) is the aggregation of asphaltenes, resulting in serious problems in downstream processing units. The present inventors now found that by combining the liquid stream coming from the pyrolysis reactor with a hydrocracker feed, and feeding the mixed feed thus obtained to a hydrocracking reactor, has a positive effect in maintaining the asphaltenes in the AR or VR in a dissolved state and would therefore reduce fouling of hydroprocessing catalysts. In other words, in such a combined feedstock the asphaltenes are kept in a dissolved state.

Moreover, a problem within the field of hydrocracking units is the presence of unwanted metals in the hydrocracker feed. The present inventors now found that by combining the liquid stream coming from the pyrolysis reactor with a hydrocracker feed, and feeding the mixed feed thus obtained to a hydrocracking reactor, results in a lower metal content of the feedstock as compared to atmospheric residue (AR) or vacuum residue (VR) without the addition of the afore mentioned liquid stream.

In addition, a problem within the field of hydrocracking units is the sulphur content of the hydrocracker feed. A high sulphur content results in production of high amounts of hydrogen sulphide which compete with hydrogen for the active sites of the hydroprocessing catalysts in the hydroprocessing reaction zone. The hydrogen partial pressure also gets reduced thus affecting the reaction performance. The present inventors now found that by combining the liquid stream coming from the pyrolysis reactor with a hydrocracker feed, and feeding the mixed feed thus obtained to a hydrocracking reactor, results in a lower sulphur content of the feedstock as compared to atmospheric residue (AR) or vacuum residue (VR) without the addition of the afore mentioned liquid stream. The present invention thus relates to the use of a liquid stream from a MWP pyrolysis reactor in a mixture with a hydrocracker feed for reducing the sulphur content of such a hydrocracker feed in a hydrocracking unit.

As discussed before, the pyrolysis of mixed waste plastics (MWP) provides gases and liquids. The gaseous product yield is rich in olefinic components. The liquid product is rich in aromatics. Depending on the severity of operations in the pyrolysis reactor, the yields of light olefins from the pyrolysis reactor can be increased and the yield of aromatics can be increased. The liquid pyrolysis product has all classes of compounds in it in varying proportions i.e. paraffins, iso-paraffins, naphthenes, olefins and aromatics.

Operating conditions for the pyrolysis reactor according to the present invention include operating conditions: 550-730 deg C., catalyst to feed ratio of 6 or greater, a catalyst composition comprising fluidized catalytic cracking (FCC) catalyst and a ZSM-5 zeolite catalyst, wherein the ZSM-5 zeolite catalyst makes up to at least 10 wt % of the catalyst composition. From the perspective of obtaining high yield of valuable petrochemicals in the downstream located hydrocracking unit it is preferred to carry out the pyrolysis reaction such that 90% of said liquid stream coming from said pyrolysis reactor boils below 350° C. The way the pyrolysis reactor is operated refers thus to a high severity pyrolysis process which not only produces more light olefins, but also produces enough aromatics to help maintain stable hydrocracker feed. Hydrocracking reactor process conditions according to the present invention include temperatures from 330-500 deg C., a pressure range from 70-200 barg, uses fixed, ebullated or slurry bed reactors. Catalysts for hydrocracking are commercially available hydrocracking catalysts like Co—Mo/Ni—Mo on alumina or those others used commercially.

The term mixed waste plastic (MWP) as used herein comprises at least one of polyolefins, polyethylene, polypropylene, polystyrene, polyethylene terephthalate (PET), polyvinyl chloride (PVC), polyamide, polycarbonate, polyurethane, polyester, natural and synthetic rubber, tires, filled polymers, composites, plastic alloys, plastics dissolved in a solvent, biomass, bio oils, and petroleum oils.

According to the present invention the liquid stream from said pyrolysis reactor is separated into a liquid stream having a high aromatics content and a liquid stream having a low aromatics content, wherein the liquid stream having a low aromatics content is sent to said hydrocracking unit. Such a separation is preferred when the hydrocracker feed is not prone to asphaltenes precipitation.

According to the present method at least one gaseous stream originating from the hydrocracking unit is further processed into valuable petrochemicals. In a preferred embodiment the gaseous stream originating from said pyrolysis reactor is combined with said at least one gaseous stream originating from said hydrocracking unit and the combined gaseous stream is further processed into valuable petrochemicals.

According to a preferred embodiment the gaseous stream from said pyrolysis reactor and said at least one gaseous stream originating from said hydrocracking unit are further processed in one or more processing units chosen from the group of steam cracking unit, propane dehydrogenation unit, butane dehydrogenation unit and combined propane/butane dehydrogenation unit, even more preferable a steam cracking unit and one or more processing units chosen from the group of propane dehydrogenation unit, butane dehydrogenation unit and combined propane/butane dehydrogenation unit.

The present process further comprises separating said gaseous stream from said pyrolysis reactor and/or and said at least one gaseous stream originating from said hydrocracking unit into a lights fraction, a C2 fraction, a C3 fraction and a C4 fraction before further processing.

It is preferred to feed said C2 fraction to said steam cracking unit, said C3 fraction to said propane dehydrogenation unit and said C4 fraction to said butane dehydrogenation unit, respectively. In case of a mixed stream comprising both C3 fraction and C4 fraction it is preferred to send that mixed stream to a combined propane/butane dehydrogenation unit, possibly with a recycle to the inlet thereof of unconverted C3 and C4.

According to a preferred embodiment the starting material mixed waste plastic (MWP) is sent to a separator for PVC removal before feeding the MWP to a pyrolysis reactor. Thus only trace PVC/chlorine is present in feed to pyrolysis unit. The segregated PVC stream can be thermally dehydrochlorinated at temperatures of up to 450 deg C. and then fed to a hydroprocessing unit or pyrolysis unit. According to this way reaction zone metallurgical issues are taken care of. According to another preferred embodiment the present process comprises no hydrogenation of any liquid stream coming from said pyrolysis reactor to free it from chlorine, before carrying out step i).

The present invention relates thus to the use of a liquid stream from a MWP pyrolysis reactor in a mixture with a hydrocracker feed for reducing the metal content of such a hydrocracker feed in a hydrocracking unit.

In addition, the present invention relates also to the use of a liquid stream from a MWP pyrolysis reactor in a mixture with a hydrocracker feed for reducing the viscosity of such a hydrocracker feed in a hydrocracking unit.

The present invention refers in step i) to a hydrocracking unit. However, in specific embodiments not only a hydrocracking unit can be used but other units as well, such as cokers, FCC units.

The present invention will be described in further detail below and in conjunction with the attached drawing. In this drawing, the pyrolysis liquid has, for example, an H/C atom ratio of 1.4-1.5 which is close to the H/C atom ratio of crude distillation bottoms from atmospheric distillation and/or vacuum distillation with the pyrolysis liquid being much lighter than the crude distillation bottoms from atmospheric distillation and/or vacuum distillation. Hence, in this case, the combined blend would have a boiling curve similar to whole crude oil According to an example wherein the aromatic compounds are extracted out from the pyrolysis liquid, then the remainder part of the pyrolysis liquid will have, for example, an H/C atom ratio of 2-2.2. This value is probably higher than the H/C atom ratio of crude distillation bottoms from atmospheric distillation and/or vacuum distillation. In a hydrocracker feed employing such a combination of the non-aromatic pyrolysis liquid and crude distillation bottoms from atmospheric distillation and/or vacuum distillation, the hydrogen content of the mixed feed thus obtained is enhanced. This route of feeding the non-aromatic from pyrolysis oil to hydrocracking unit is especially useful in cases where the crude oil residue, as a feed for the hydrocracking unit, is not prone to asphaltenes precipitation by blending the crude oil residue with this non-aromatic pyrolysis oil.

The present invention teaches an integrated process to maximize petrochemicals from plastics and also teaches how to prepare feed blends to maintain a stable feed to hydrocracker. The present invention preferably employs a high severity pyrolysis process upfront to maximize light olefins and produce aromatic liquid (with close to 90 wt % of the liquids boiling below 350 deg C.) to help in hydrocracker feed stability.

BRIEF DESCRIPTION OF THE DRAWINGS

The sole FIGURE is a schematic illustration of an embodiment of the process of the invention.

DETAILED DESCRIPTION OF THE INVENTION

Referring now to the process and apparatus 101 schematically depicted in the sole FIGURE, there are shown a pyrolysis reactor 2 and a hydrocracking unit 9. Mixed waste plastic 1 is introduced into pyrolysis reactor 2 resulting in a gas product 12 and a liquid product 5. Gas product 12 can be further separated into individual streams, like stream 13 comprising $H_2$, CO, $CO_2$, $CH_4$, stream 14 comprising ethane, stream 15, comprising propane, stream 16, comprising butane and stream 17, comprising ethylene, propylene, butenes. Stream 14 can be further processed in a steam cracker, stream 15 in a propane dehydrogenation unit and stream 16 in a butane dehydrogenation unit, respectively. As mentioned before, mixed waste plastic (MWP) 1 can undergo a separation step (not shown here) for PVC removal before feeding the MWP to pyrolysis reactor 2. The segregated PVC stream can be thermally dehydrochlorinated at temperatures of up to 450 deg C. nd then fed to pyrolysis reactor 2.

In a preferred embodiment liquid stream 5 from pyrolysis reactor 2 is separated in separation unit 4 into a stream 6 having high aromatics content and a stream 7 having a low aromatics content, wherein stream 7 having low aromatics content is sent to hydrocracker unit 9. Stream 7 is fed, together with a hydrocracker feed 3, to the inlet of hydrocracking unit 9. In hydrocracking unit 9 the mixed liquid feed thus introduced is in the presence of hydrogen (not shown) hydrocracked and converted into a gaseous product 11 and a liquid product 10, in which liquid product 10 can be further processed in different chemical processes. Gaseous product 11 will be further processed into valuable petrochemicals. Gas product 11 can be further separated into individual streams, like stream 13 comprising H2, CO, CO2, CH4, stream 14 comprising ethane, stream 15, comprising propane, stream 16, comprising butane and stream 17, comprising ethylene, propylene, butenes. Stream 14 can be further processed in a steam cracker, stream 15 in a propane dehydrogenation unit and stream 16 in a butane dehydrogenation unit. Gas product 11 can also be mixed with gas product 12, and the mixed gaseous product is further processed into valuable petrochemicals as discussed above. Examples of hydrocracker feed 3 are for example crude distillation bottoms from atmospheric distillation and/or vacuum distillation. Although unit 9 has been identified as a hydrocracking unit, unit 9 can also be a coker or a FCC unit. Examples of "valuable petrochemicals" as used herein relate to starting materials, such as for example H2, CO, CO2, CH4, ethane, propane, butanes, ethylene, propylene and butenes, but also to benzene, toluene and xylenes (BTX).

The following additional benefits also arise from combining these mixed plastic pyrolysis oils with a hydrocracker feed, such as crude distillation bottoms from atmospheric distillation and/or vacuum distillation.

A feature is that the metal content of the combined feed is reduced as compared to only crude distillation bottoms from atmospheric distillation and/or vacuum distillation. This makes the demetallizing requirement per unit volume of feed lower in the hydroprocessing reactor.

Another feature is that the addition of the pyrolysis liquid also reduces the viscosity of crude distillation bottoms from atmospheric distillation and/or vacuum distillation making the combined stream easier to pump and more amenable to hydroprocessing.

Another feature is that the present inventors assume that asphaltenes are more stable in solutions having lower viscosity which is enabled by the present invention. As a result fouling of hydroprocessing catalyst by deposition of asphaltenes is reduced.

As mentioned before, splitting the pyrolysis liquid into aromatic and non-aromatic and sending the non-aromatic along with crude distillation bottoms from atmospheric distillation and/or vacuum distillation for hydrocracking is a benefit of the present method as well. The aromatics can by-pass the hydrocracker unit to give higher yields of aromatics. This route of feeding the non-aromatic from pyrolysis oil to hydrocracking unit to enhance yield of petrochemicals is especially useful in cases where the crude oil residue, as a feed for the hydrocracking unit, is not prone to asphaltenes precipitation by blending the crude oil residue with this non-aromatic pyrolysis oil.

In a situation where crude oil residues are prone to asphaltenes precipitation it is preferred to blend the whole pyrolysis oil with crude oil residues without being subjected to aromatic extraction. In these embodiments the aromatics present in pyrolysis oil will boost the overall aromatics content in the feed to hydrocracking unit that will keep the asphaltenes in a dissolved condition. Crude oil residues are blended with pyrolysis oil in such a proportion by weight or volume which results in the combined mixture of the feed and solvent prior to entering the hydroprocessing unit or its feed heaters having an S value measured as per ASTMD7157-12 of greater than 1.

Example 1

An in-situ fluidized bed lab tubular reactor having a length of 783 mm and an inner diameter of 15 mm was used. The reactor was housed in a split-zone 3-zone tubular furnace with independent temperature control for each zone. The size of each zone was 9.3 inches (236.2 mm). The overall heated length of the reactor placed inside the furnace was 591 mm. The reactor wall temperature was measured at the centre of each zone and was used to control the heating of each furnace zone. The reactor had a conical bottom and the reactor bed temperature was measured using a thermocouple housed inside a thermowell and placed inside the reactor at the top of the conical bottom. Also, the reactor wall temperature was measured at the conical bottom to ensure that the bottom of the reactor was hot. The reactor bottom was placed at the middle of the furnace bottom zone for minimizing the effect of furnace end cap heat losses and maintaining the reactor bottom wall temperature within a difference of 20° C. of the internal bed temperature measured. 1.5 g of a mixed plastic feed was prepared having a composition 19 wt % HDPE, 21 wt % LDPE, 24 wt % PP, 12 wt % C4-LLDPE, 6 wt % C6-LLDPE, 11 wt % PS and 7 wt % PET. Spent FCC catalyst was used in combination with a ZSM-5 zeolite catalyst in the proportion 62.5 wt % spent FCC catalyst and 37.5 wt % ZSM-5 zeolite catalyst. The plastic feeds were in the form of a 200 micron plastic powder. The FCC catalyst was a spent FCC catalyst obtained from an operating refinery. The FCC spent catalyst used had a residual coke on it of 0.23 wt %. The ZSM-5 zeolite catalyst used was a commercially available ZSM-5 zeolite catalyst. The dry catalyst mixture used in the experiment was 8.95 g. The catalyst/plastic feed ratio employed was 5.96. The plastic feed was mixed with catalyst by swirling in a cup and then fed into the reactor. Before charging of the feed, the bed temperature as measured by the reactor internal thermocouple was 700° C. A flow of $N_2$ gas at 175 Ncc/min (normal cc/min) was used as a fluidizing and carrier gas. The conversion products from the reactor were collected and condensed in a condenser. The uncondensed products were collected in a gas collection vessel and the gas composition was analyzed using a refinery gas analyzer (M/s AC Analyticals B.V., The Netherlands). Liquid products were characterized for their boiling point distribution using a simulated distillation GC (M/s AC Analyticals B.V., The Netherlands). In addition a detailed hydrocarbon analysis (up to C13 hydrocarbons) was carried out using a DHA analyzer (M/s AC Analyticals B.V., The Netherlands). The coke deposited on the catalyst was determined using an IR-based CO and CO2 analyzer. The mass balances were determined by summing the yields of gas, liquid and coke. Individual product yields were determined and reported on a normalized product basis. These results are presented in Table 1 below.

The yield of light gas olefins from this experiment was 34.91 wt %. The product yields were 46.6 wt % gas, 50.4 wt % liquids and 3.1 wt % coke. The yield of liquid product boiling <220 deg C. was 43.57 wt %. The detailed hydrocarbon analysis of the liquid product boiling <240 deg C. is provided in Table 2. The liquid had 75.4 wt % aromatics in it.

TABLE 1

Yields of products from pyrolysis of mixed plastics

| Products from mixed plastic pyrolysis | wt. % |
|---|---|
| H2 | 0.14 |
| Methane | 1.49 |
| Ethane | 0.92 |
| ethylene | 6.77 |
| carbon dioxide | 1.85 |
| propane | 2.95 |
| propylene | 15.84 |
| i-butane | 2.77 |
| n-butane | 1.15 |
| t-2-butene | 2.98 |

TABLE 1-continued

Yields of products from pyrolysis of mixed plastics

| Products from mixed plastic pyrolysis | wt. % |
|---|---|
| 1-butene | 2.08 |
| i-butylene | 4.90 |
| c-2-butene | 2.20 |
| 1,3-butadiene | 0.14 |
| Carbon monoxide | 0.39 |
| Gasoline | 43.57 |
| Diesel | 5.82 |
| Heavies | 0.98 |
| Coke | 3.06 |

TABLE 2

Detailed hydrocarbon analysis of the mixed plastic pyrolysis stream boiling below 240 deg C.

| Carbon | n-parrafins | Iso-parrafins | Olefins | Naph-thenes | Aro-matics | Total |
|---|---|---|---|---|---|---|
| C5 | — | — | 0.017 | — | — | 0.017 |
| C6 | 0.03 | 0.04 | 0.361 | 0.08 | 3.99 | 4.50 |
| C7 | 0.32 | 0.58 | 1.294 | 0.33 | 14.82 | 17.34 |
| C8 | 0.44 | 2.05 | 0.316 | 0.88 | 31.96 | 35.63 |
| C9 | 0.23 | 5.14 | 0.111 | 1.51 | 13.11 | 20.10 |
| C10 | 0.15 | 2.50 | — | 0.30 | 4.85 | 7.80 |
| C11 | 0.13 | 3.42 | 0.038 | 0.35 | 2.21 | 6.16 |
| C12 | 0.08 | 0.16 | — | — | 4.43 | 4.67 |
| C13 | 0.03 | — | — | — | — | 0.03 |
| total | 1.41 | 13.88 | 2.137 | 3.44 | 75.37 | 96.25 |
| | | | | | Total unknowns | 3.727 |
| | | | | | Total Heavies | 0.026 |

Example 2

The Saturates, aromatics, resins and asphaltenes (SARA) analysis of the 340+ deg C. residue (AHAR) from Arab heavy crude oil is 53.7/34.8/3.1/8.1. The SARA analysis for plastic pyrolysis oil (PPoil) boiling below 240 deg C. is 24.6/75.4/0/0. The combination of these streams in different weight proportions is analysed in the below table along with predicted stable asphaltenes concentration in these mixtures.

| | 100% AHAR | 70% AHAR + 30% PPOil | 50% AHAR + 50% PPoil | 25% AHAR + 75% PPoil | 100% PPoil |
|---|---|---|---|---|---|
| Asphaltenes | 8.1 | 5.7 | 4.1 | 2.0 | 0.0 |
| Saturates | 53.7 | 45.0 | 39.2 | 31.9 | 24.6 |
| Aromatics | 34.8 | 47.0 | 55.1 | 65.2 | 75.4 |
| Resins | 3.1 | 2.2 | 1.6 | 0.8 | 0.0 |
| Predicted stable Asphaltene concentration in mixture from aromatics and resins concentration in mixture | 4.6 | 6.3 | 7.4 | 8.8 | 10.2 |

As can be seen from the table, stable asphaltenes combinations can be obtained in the mixture of AHAR with PPoil in all proportions exceeding at or above 30 wt % of PPoil in the mixture.

Example 3

50.39 kg of the pyrolysis oil produced by pyrolysis of 100 Kg of mixed plastics as given in example 1 is mixed with 200 Kg of Arab light AR and fed to a hydrocracking unit operating at 394 deg C. and 186 Kg/cm$^2$ g. The yield is as below:

| Product | Yield, Kg |
|---|---|
| H2 | |
| Methane + ethane | 4.9 |
| Propane | 8.1 |
| Butane | 17.0 |
| ethylene | 0 |
| propylene | 0 |
| Butenes | 0 |
| 1,3-butadiene | 0 |
| carbondioxide | 0 |
| Carbonmonoxide | 0 |
| C5-150 deg C. | 93.2 |
| H2S | 4.5 |
| NH3 | 0.2 |
| 150-288 deg C. | 87.1 |
| 288-343 deg C. | 30.6 |
| 343+ deg C. | 4.9 |

Example 4

The overall process yields by processing 100 Kg of mixed plastic and 200 Kg AL AR in a combination of pyrolysis and hydrocracking under conditions mentioned in examples 1 and 3 above as compared to processing of 300 Kg of AL AR under the same conditions is as given below:

| Product | From 100 Kg plastic + 200 Kg AL AR | From 300 Kg AL AR |
|---|---|---|
| H2 | 0.14 | 0.00 |
| Methane + ethane | 7.34 | 2.45 |
| Propane | 11.03 | 4.35 |
| Butane | 20.89 | 9.20 |
| ethylene | 6.77 | 0.00 |
| propylene | 15.84 | 0.00 |
| Butenes | 12.16 | 0.00 |
| 1,3-butadiene | 0.14 | 0.00 |
| carbondioxide | 1.85 | 0.00 |
| Carbonmonoxide | 0.39 | 0.00 |
| C5-150 deg C. | 93.16 | 82.85 |
| H2S | 4.46 | 7.13 |
| NH3 | 0.18 | 0.29 |
| 150-288 deg C. | 87.11 | 137.01 |
| 288-343 deg C. | 30.58 | 48.85 |
| 343+ | 4.90 | 7.86 |
| Acetylene | | |
| Coke | 3.06 | |

As can be seen from this example, when plastic pyrolysis oil is co-processed with AL AR in the hydroprocessing unit, it results in lower H2S and NH3 and higher yields of ethane, propane, butane, C5-150 deg C. naphtha cut and good yields of ethylene, propylene and butenes.

Example 5

The overall process yields by processing 100 Kg of mixed plastic and 200 Kg AL AR in a combination of pyrolysis and hydrocracking under conditions mentioned in examples 1 and 3 above with further conversion of ethane, propane and butane formed in the process in ethane steam cracking, propane dehydrogenation and butane dehydrogenation respectively as compared to processing of 300 Kg of AL AR under the same conditions and adopting the same upgrading steps for ethane, propane and butane is as given below:

| Product | Total yield from 300 Kg feed ALAR + Plastic, Kg | Total yield from 300 Kg ALAR, Kg |
|---|---|---|
| H2 | 1.55 | 0.57 |
| Methane + ethane | 4.01 | 1.40 |
| Propane | 0.01 | 0.00 |
| Butane | | |
| ethylene | 12.31 | 2.04 |
| propylene | 25.21 | 3.71 |
| Butenes | 30.90 | 8.22 |
| 1,3-butadiene | 0.14 | 0.00 |
| carbondioxide | 1.85 | 0.00 |
| Carbonmonoxide | 0.41 | 0.00 |
| C5-150 deg C. | 93.29 | 82.89 |
| H2S | 4.46 | 7.13 |
| NH3 | 0.18 | 0.29 |
| 150-288 deg C. | 87.11 | 137.01 |
| 288-343 deg C. | 30.58 | 48.85 |
| 343+ | 4.90 | 7.86 |
| Acetylene | 0.03 | 0.01 |
| Coke | 3.06 | |

As can be seen from this example, when mixed plastics pyrolysis and AL AR are processed as discussed above and ethane, propane and butanes formed are further converted using steam cracking, propane dehydrogenation and butane dehydrogenation steps respectively, the resulting overall process gives much higher yields of ethylene, propylene, butenes and C-150 deg C. naphtha cut. Also, the yields of H2S and NH3 are reduced.

Example 6

A combination of AL crude oil residues with plastic pyrolysis oil results in a reduction of the metals concentration in the combined feed stream as per table below:

| | 340+ deg C. AL AR | 565+ deg C. AL VR | Mixed plastic pyrolysis liquid | 75% AL AR: 25% Mixed plastic pyrolysis liquid | 75% AL VR: 25% Mixed plastic pyrolysis liquid |
|---|---|---|---|---|---|
| Metals, ppmw | 27.3 | 253.6 | 0 | 20.5 | 190.2 |

The present inventors found that mixed waste plastics (MWP) can be converted to valuable chemicals in a pyrolyzer. The liquid portion can be upgraded in a hydrocracker. The pyrolysis oil results in higher amounts of propane and butanes from the hydrocracker as compared to AL AR. Hence, there is a higher generation of petrochemicals when PPOiI is processed with AL AR in hydrocracker. A portion of the PPoil boils from 220-370 deg C. and a portion of the PPoil boils below 220 deg C. The performances of these cuts in a hydrocracker can be approximated by the performance of LCO and FCC naphtha in a hydrocracker. Example 5 captures this effect of feed differences on the hydrocracker yields.

| | wt % yield from Hydrocracking FCC LCO and gasoil blends | Wt % yield from Hydrocracking FCC Heavy naphtha | Wt % yield from hydrocracking AL AR |
|---|---|---|---|
| C1 + C2 | 4.13 | 5.62 | 0.82 |
| C3 | 5.79 | 8.98 | 1.45 |
| C4 | 15.70 | 18.25 | 3.07 |
| C5-150 deg C. | 58.51 | 67.15 | 27.62 |
| HN (94-193 deg C.) | | 0.00 | 0.00 |
| H2S | 0.00 | 0.00 | 2.38 |
| NH3 | 0.00 | 0.00 | 0.10 |
| 150-288 | 15.87 | | 45.67 |
| 288-343 | | | 16.28 |
| 343+ | | | 2.62 |

Another advantage of the present method is the solubility of asphaltenes brought in by mixing AL AR with the PPOiI. In there is a lowering of H2S yields which can improve hydrocracking of the AL AR as more catalyst sites are available for hydrocracking of AL AR. Also there are less metals and lowering of NH3 which are both good for hydrocracking. From an engineering perspective, there can be increased vaporization as a result of presence of lower boiling material in the feed which can probably aid in better dispersion and wetting of feed and catalyst and thus better utilization of catalyst. Furthermore reactor feed furnaces can face an increased heat duty requirement as some lighter components can vaporize resulting in a latent heat load.

The invention claimed is:

1. A process for converting mixed waste plastic (MWP) into petrochemicals, the process comprising the steps of feeding mixed waste plastic (MWP) to a pyrolysis reactor, converting said MWP into a gaseous stream and a liquid stream, and further processing said gaseous stream into petrochemicals, said process further comprising the steps of:

i) separating said liquid stream from said pyrolysis reactor into a first liquid portion and a second liquid portion, wherein said first liquid portion comprises more aromatics than the second liquid portion, and feeding said second liquid portion, together with a hydrocracker feed, to a hydrocracking unit;

ii) converting said second liquid portion, together with said hydrocracker feed, through hydrocracking into at least one gaseous stream and a second liquid stream; and iii) further processing said at least one gaseous stream into the petrochemicals, wherein said hydrocracker feed comprises crude distillation bottoms from at least one member selected from the group consisting of atmospheric distillation and vacuum distillation.

2. The process according to claim 1, further comprising no hydrogenation of any liquid stream coming from said pyrolysis reactor to free it from chlorine, before carrying out step i).

3. The process according to claim 1, further comprising feeding said mixed waste plastic (MWP) to a separator for PVC removal before feeding the MWP to said pyrolysis reactor to obtain a segregated PVC stream, wherein the segregated PVC stream is thermally dehydrochlorinated at a temperature of up to 450° C. and fed to said pyrolysis reactor.

4. The process according to claim 1, further comprising mixing said second liquid portion and said hydrocracker feed in such a proportion by weight or volume which results in the combined mixture prior to entering the hydrocracking unit or feed heaters having an S value measured as per ASTMD7157-12 of greater than 1.

5. The process according to claim 1, further comprising combining said gaseous stream originating from said pyrolysis reactor with said at least one gaseous stream originating from said hydrocracking unit and further processing the combined gaseous stream into petrochemicals.

6. The process according to claim 1, wherein a pyrolysis reaction is carried out in said pyrolysis reactor such that 90% of said liquid stream coming from said pyrolysis reactor boils below 350° C.

7. The process according to claim 1, wherein said gaseous stream from said pyrolysis reactor and said at least one gaseous stream originating from said hydrocracking unit are further processed in at least one processing unit selected from the group consisting of a steam cracking unit, a propane dehydrogenation unit, a butane dehydrogenation unit and a combined propane/butane dehydrogenation unit.

8. The process according to claim 7, wherein said gaseous stream from said pyrolysis reactor and said at least one gaseous stream originating from said hydrocracking unit are further processed in a steam cracking unit and at least one combined propane/butane dehydrogenation unit.

9. The process according to claim 7, further comprising separating said gaseous stream from said pyrolysis reactor and/or said at least one gaseous stream originating from said hydrocracking unit into a fraction comprising methane and hydrogen, a C2 fraction, a C3 fraction and a C4 fraction before further processing.

10. The process according to claim 9, further comprising feeding said C2 fraction to said steam cracking unit, said C3 fraction to said propane dehydrogenation unit and said C4 fraction to said butane dehydrogenation unit, respectively.

* * * * *